United States Patent [19]

Bruhn

[11] Patent Number: 5,033,414

[45] **Date of Patent: * Jul. 23, 1991**

[54] HEAT RECOVERY SYSTEM

[75] Inventor: Alfred Bruhn, Eastchester, N.Y.

[73] Assignee: American Hydrotherm Corporation, New York, N.Y.

[ * ] Notice: The portion of the term of this patent subsequent to Jul. 4, 2006 has been disclaimed.

[21] Appl. No.: 339,130

[22] Filed: Apr. 14, 1989

Related U.S. Application Data

[63] Continuation-in-part of Ser. No. 168,421, Mar. 15, 1988, Pat. No. 4,844,020.

[51] Int. Cl.[5] ..... F22B 1/18; F22B 3/02

[52] U.S. Cl. ..... 122/7 B; 122/7 R; 122/33; 122/483; 431/5; 110/210; 165/104.31

[58] Field of Search ..... 122/7 R, 7 A, 7 B, 33, 122/483, 2; 165/909, 104.28; 110/210, 211, 212, 214, 234; 431/5

[56] References Cited

U.S. PATENT DOCUMENTS

| | | | |
|---|---|---|---|
| 1,833,130 | 11/1931 | Roe | 165/909 |
| 4,245,571 | 1/1981 | Przewalski | 110/212 |
| 4,257,579 | 3/1981 | Bruhn et al. | 237/56 |
| 4,340,207 | 7/1982 | Bruhn et al. | 165/909 |
| 4,628,869 | 12/1986 | Symsek et al. | 122/7 R |
| 4,820.500 | 4/1989 | Obermuller | 431/5 |
| 4,890,581 | 1/1990 | Natter | 431/5 |

*Primary Examiner*—Albert W. Davis, Jr
*Attorney, Agent, or Firm*—Louis E. Marn

[57] ABSTRACT

There is disclosed an apparatus for burning a waste gaseous stream having a residual heating value represented by a heat of combustion of from 50 to 900 BTU/SCF. to heat an intermediate heat transfer fluid, and to use the thus heated heat transfer fluid to heat diverse fluids in a plurality of serially arrayed heat exchangers at descending temperature levels.

3 Claims, 1 Drawing Sheet

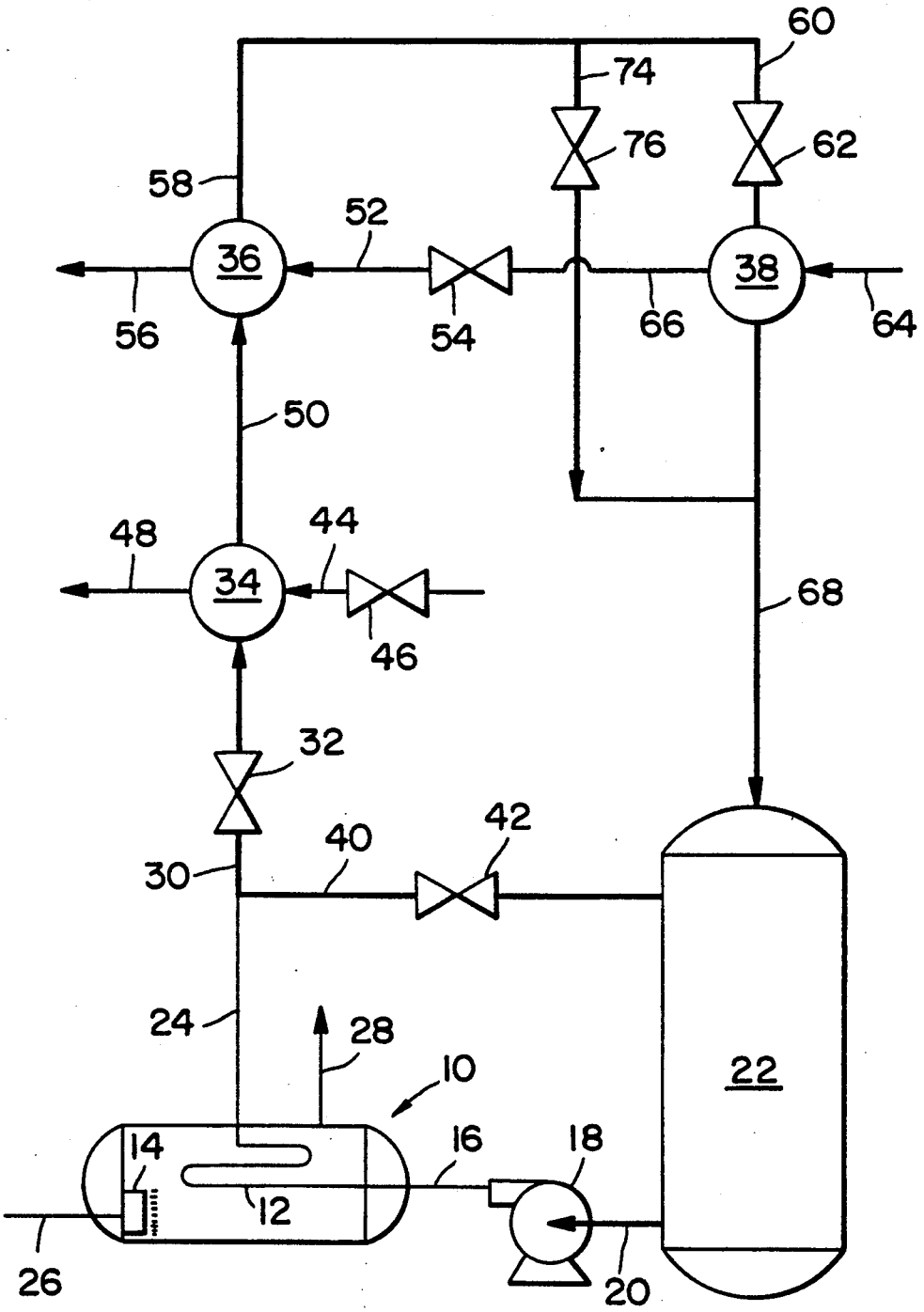
60
74
76
62
58
52
36
38
56
54
66
64
50
48
44
34
68
46
32
42
40
30
24
28
10
22
14
16
18
12
26
20

HEAT RECOVERY SYSTEM

This is a continuation-in-part of United States application Ser. No. 07/168,421, filed Mar. 15, 1988 now U.S. Pat. No. 4,844,020 granted July 4, 1989.

BACKGROUND OF THE INVENTION (1) Field of the Invention

This invention relates to the recovery of heating values, and more particularly to an apparatus and process for the recovery of heating values of waste gaseous streams.

(2) Description of the Prior Art

Cogeneration and heat recovery systems normally recover heat from hot gases leaving a gas turbine, gas engine, or other source of hot gas by generating steam which is used for process or space heating, for driving a steam turbine and generating electricity or for driving a pump or compressor. Infrequently, a high temperature thermal liquid stream is used to recover heat and transfer the heat to other streams via heat exchangers.

A frequent application of heat recovery systems is one in which hot gases leaving a gas turbine in the range of 800° to 950° F. produces power at a steady rate which is sold to a local power company, split between the power company and operating company or used by the operating company. Generally, there is an excess of heat available or the heat uses vary depending on plant operation, and therefore, some of the hot gases by-pass the heat recovery system via expensive and somewhat unreliable large by-pass stack damper. An expensive and complex control system is required to automatically modulate the opening of such damper, and in the case of failure of the by-pass, steam pressure will rise to elevated pressures and/or the heat transfer fluid will rise to an elevated temperature which might require automatic shutdown of the gas turbine or the source of the hot gases.

In a hot oil recovery unit, heat transfer design is very complex and expensive because oil will break down if its maximum film temperature 730° to 830° F. is exceeded due to oil flow interruptions, gas flow interruptions or overfiring. Therefore, the capital cost is high as is operating cost to replace or replenish the heat transfer oil.

In U.S. Pat. No. 4,257,579 to Bruhn et al. and assigned to the same assignee as the present invention, there is disclosed a waste heat recovery system using at least two heat exchange recovery systems utilizing intermediate heat transfer mediums for a process operation producing an exhaust or waste gas at temperatures of from 500° to 2500° F. wherein the heat exchanges unit may be fabricated using conventional materials of construction and wherein heat may be recovered at levels substantially higher than with the use of a single intermediate heat transfer medium, however, such systems depend upon using two or more heat recovery systems and each system has to have the ability to fully use all the heat that is recovered in each system.

In the aforementioned copending application, there is disclosed a heat recovery system and process utilizing a primary heat transfer salt mixture to recover heat from an exhaust or waste gas having a temperature of from 500° to 2500° F., and to use such primary heat transfer salt mixture in a plurality of serially arrayed heat exchangers as a heating medium for diverse fluids at descending temperature levels. After heat recovery, the thus cooled waste gas is flared or vented to atmosphere notwithstanding low heating value content of the cooled waste gases.

OBJECTS OF THE PRESENT INVENTION

It is an object of the present invention to provide an improved apparatus and process for recovering heating values from a waste gaseous stream.

Another object of the present invention is to provide an improved apparatus and process for recovering heating values from a waste gaseous stream at reduced capital costs.

Yet another object of the present invention is to provide an improved apparatus and process for recovering heating values from a waste gaseous stream of greater reliability.

SUMMARY OF THE INVENTION

These and other objects of the present invention are achieved in an apparatus for burning a waste gaseous stream having a residual heating value of from 50 to 900 BTU/SCF to heat an intermediate heat transfer fluid, such as eutectic heat transfer salt mixture and to use the thus heated heat transfer salt mixture in a plurality of serially arrayed heat exchangers at descending temperature levels as a heating medium for diverse fluids.

BRIEF DESCRIPTION OF THE DRAWING

The invention will be more clearly understood by reference to the following description of an exemplary embodiment thereof when taken in conjunction with the accompanying drawing illustrating a schematic flow diagram thereof.

DETAILED DESCRIPTION OF THE INVENTION

Referring now to the drawing, there is illustrated a furnace assembly, generally indicated as 10, including a heat transfer coil 12 and a burner assembly 14. The heat transfer coil 12 is in fluid communication via line 16 to the discharge side of a pump 18 having a suction side in fluid flow communication via line 20 with a storage tank 22 containing an intermediate heat transfer fluid, such as eutectic salt mixture, oil or the like. A heated intermediate heat transfer fluid in the coil 12 is withdrawn from the heater assembly 10 by line 24 as more fully hereinafter described.

The burner assembly 14 is in gas flow communication via line 16 with a source (not shown) of a waste gaseous stream, such as the off gas from a blast furnace having a residual heating value as prepresented by a heat of combustion of from about 50 to 900 U/SCF, due to the presence of carbon monoxide, hydrogen and the like. The heating value of such waste gas stream is not used since waste gas flow from a blast furnace varies from 0 to maximum flow 8 times in the space of one hour due to processing factor inherent in blast furnace operation which thereby produces an intermittent flow of the waste gaseous stream.

The waste gaseous stream in line 26 is admixed with a combustion supporting medium and burned in the burner assembly 14 to produce a heated gaseous stream for passage in indirect heat transfer with the intermediate heat transfer fluid in the heat transfer coil 12 and is thence vented via line 28 to the atmosphere. After recovery of heating values by the intermediate heat transfer fluid in the heater 10, the thus heated intermediate heat transfer fluid at a temperature of from 600° to 1000° F. is withdrawn in line 24 from the heater 10 and is serially passed by line 30 under the control valve 32 through heat exchangers 34, 36 and 38 for heating process streams therein at diverse temperature levels or for recycle by line 40 under the control of valve 42 to the storage tank 22 as more fully hereinafter discussed.

In heat exchanger 34, the heated intermediate heat transfer fluid in line 30 is passed in indirect heat transfer relationship with a first process fluid, introduced by line 44 under the control of valve 46. The process fluid, is heated to a higher temperature level of from 500° to 600° F. and is withdrawn by line 48 and passed to an in plant unit process or operation (not shown). The intermediate heat transfer fluid at a lower temperature level of from 650° to 900° F. is withdrawn by line 50 from the heat exchanger 34 and passed to the heat exchanger 36 to be passed in indirect heat transfer relationship to a second process fluid, such as high pressure steam introduced by line 52 under the control of valve 54. The second process fluid is heated to a temperature level of from 490° to 700° F., and withdrawn by line 56 from the heat exchanger 36 and passed to an in plant unit process or operation (not shown).

The intermediate heat transfer fluid in line 58 is introduced into the heat exchanger 38 by line 60 under the control of valve 62 and passed in indirect heat transfer relationship to a third process fluid, such as high pressure feed water in line 64 and heated to form steam at temperature level of from 400° to 600° F. The thus generated steam is withdrawn by line 66 from the heat exchanger 38 and passed to the heat exchanger 36 via line 52 under the control of valve 54 as the source of steam therein. The intermediate heat transfer fluid at still a lower temperature level of from 450° to 650° F. is withdrawn from the heat exchanger 38 by line 68 and passed to the intermediate heat transfer fluid storage tank 22 for cycling through the apparatus of the present invention.

Depending on plant requirements for heated process fluids at predetermined temperature levels and flow rates, all or a portion of the heat transfer fluid in line 58 may be caused to by-pass the heat exchanger 38 by passing such heat transfer fluid by line 74 under the control of valve 76 to be combined in line 68 with any intermediate heat transfer fluid therein for passage to the storage tank 22.

Assuming that the total waste heat potential (as represented by residual heat of combustion) of the waste gaseous stream in line 26 is removed in the heat exchanger 10 is totally distributed to the process streams passing through the heat exchangers 34, 36 and 38, the temperature level of the intermediate heat transfer fluid in the storage tank 22 will remain constant, however, a decrease or increase in heat requirements of the process fluids will cause the temperature level of the intermediate heat transfer fluid in the storage tank 22 to be raised or lowered, respectively, as will be understood by one skilled in the art. In accordance with the present invention, the residual heating value of the waste gaseous stream in line 26 may be recovered while using and/or storing such recovered heating values for usage as required by process units to provide heated fluids in lines 48 and 56 from the heat exchangers 34, 36 and 38, respectively.

As hereinbefore mentioned, the waste gaseous stream is usually available in intermittent fluid flow, thus heat and flow requirements may require recycling through the storage tank 22 via lines 24 and 40 by closing valve 32 and opening valve 42 of the heated intermediate heat transfer fluid during certain periods of operation, i.e. thermal storage. The opening of valve 76 and closing of valve 62 will cause less heat to be transfered in heat exchangers 38 and the storage tank 22, temperature will increase and more heat will be stored.

EXAMPLE OF THE INVENTION

Operation of the apparatus of the present invention is illustrated in the following example which is intended to be merely illustrative and the invention is not to be regarded as limited thereto.

EXAMPLE

A waste heat furnace gaseous stream at a temperature of 100° F. is intermittently introduced (8 cycles/hour) at a flow that varies from 0 to 50,000 SCFM and burned in the heater 10 to heat in indirect heat transfer relationship a salt mixture to form a heated salt mixture which is cooled by superheating high pressure steam and generating high pressure steam.

Because of the thermal storage, a steady flow of superheated high pressure steam is produced which can generate 6000 KW of power. When operating 330 days per year and a value of $.05 per KWH, the power has a value of $2,376,000. per year, with an installed cost of $5,000,000. and total operating and capital recovery costs of $1,500,000., the project shows a gross profit of $876,000. per year.

While the present invention has been described with particular reference to the use of a eutetic salt mixture, it will be understood that other intermediate heat transfer fluid may be used, e.g. Dowtherm A ® (a registered trademark of Dow Chemical Co. Inc.), Therminal 66 ® (a registered trademark of Monsanto Co.), etc.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed is:

1. A heat recovery system, which comprises:

a storage tank for an intermediate heat transfer fluid;

a heater for burning a waste gaseous stream having heating values of from 50 to 900 BTU/SCF to heat said intermediate heat transfer fluid to recover heating values of said waste gaseous stream;

conduit means for introducing said waste gaseous stream into said heater;

conduit means for passing said intermediate heat transfer fluid from said storage tank to said heater;

a plurality of serially arrayed heat exchanger means for passing the heated intermediate heat transfer fluid in indirect heat transfer relationship with fluids at descending temperature levels for recovery of said heating values:

conduit means for passing said intermediate heated heat transfer fluid to said plurality of heat exchanger means from said heater; and conduit means for passing said intermediate heat transfer fluid from said plurality of heat exchangers to said storage tank.

2. The heat recovery system as defined in claim 1 wherein said plurality of heat exchangers means serially include a first heat exchanger for producing superheated stream and a second heat exchanger for producing steam.

3. The heat recovery system as defined in claim 2 and further including a third exchanger for generating steam and conduit means for passing said stream from said third heat exchanger to said first heat exchanger for producing superheated stream.

* * * * *